US005407332A

United States Patent [19]

Yedinak et al.

[11] Patent Number: 5,407,332

[45] Date of Patent: Apr. 18, 1995

[54] HIGH SUCTION INTAKE WIPER

[75] Inventors: John A. Yedinak, Downers Grove; William A. Weikel, Streamwood; James M. Nelson, Itasca; Eugene H. Styer, Antioch, all of Ill.

[73] Assignee: Graco Inc., Minneapolis, Minn.

[21] Appl. No.: 831,952

[22] Filed: Feb. 6, 1992

[51] Int. Cl.[6] ..... F04B 7/04

[52] U.S. Cl. ..... 417/489; 417/490; 417/900; 92/241; 92/250

[58] Field of Search ..... 417/489, 490, 900; 92/240, 241, 250

[56] References Cited

U.S. PATENT DOCUMENTS

| | | | |
|---|---|---|---|
| 1,762,602 | 6/1930 | Wideman . | |
| 2,211,455 | 8/1940 | Caldwell | 309/23 |
| 2,637,304 | 1/1950 | Dinkelkamp | 92/250 |
| 2,836,474 | 5/1958 | Mosher | 309/33 |
| 2,958,445 | 11/1060 | Jesse | 222/386 |
| 2,985,358 | 5/1961 | Lee et al. | 417/490 |
| 3,143,934 | 8/1964 | Nelson | 92/250 |
| 3,144,256 | 8/1964 | Wright | 277/208 |
| 3,153,385 | 10/1964 | Bowen, Jr. | 417/490 |
| 3,354,794 | 11/1967 | Dailey | 92/243 |
| 3,537,621 | 11/1970 | Jesse | 222/386 |
| 3,744,382 | 7/1973 | Williams | 92/206 |
| 4,047,854 | 9/1977 | Penn | 417/900 |
| 4,949,750 | 8/1990 | Goodwin et al. | 137/510 |

FOREIGN PATENT DOCUMENTS

| | | | |
|---|---|---|---|
| 0510002 | 10/1930 | Germany | 92/240 |
| 0253856 | 12/1930 | Italy | 92/250 |
| 0197246 | 10/1938 | Switzerland | 92/240 |

OTHER PUBLICATIONS

"Bulldog and King Pumps," Graco Instructions—Parts list, #306-646, Rev R., Oct. 1990.

*Primary Examiner*—Richard A. Bertsch
*Assistant Examiner*—Charles G. Freay
*Attorney, Agent, or Firm*—Douglas B. Farrow

[57] ABSTRACT

In a priming piston loading double acting pump for high viscosity materials, the shovel plate assembly is formed of a flexible, abrasion resistant disk or cup. The disk may be made from silicon rubber and the cup may be made from a glass filled Teflon polytetrafluoroethylene material. The clearance between the plate assembly and the intake cylinder is essentially zero to allow for a build-up of a vacuum as the plate assembly moves downwardly and out of the intake cylinder to greatly enhance the loading ability of the pump.

6 Claims, 1 Drawing Sheet

HIGH SUCTION INTAKE WIPER

BACKGROUND OF THE INVENTION

For many years, double acting piston pumps have been used to pump various types of viscous materials. With higher viscosity materials, so-called shovel pumps or priming piston pumps are well known, one example being manufactured by the Assignee of the instant invention under the trademark Bulldog® and bearing part number 204-287 (the contents of the attached manual for that product are hereby incorporated by reference.)

While such pumps generally work well with higher viscosity materials, some extremely high viscosity materials are hard to load and do not pump well. The prior art devices have generally utilized a metal shovel plate assembly having a substantial amount of clearance (on the order of 0.2 inch) between the disk and the intake cylinder.

SUMMARY OF THE INVENTION

It is therefore an object of this invention to provide a construction for a shovel pump which is capable of loading the hardest to load high viscosity materials for enhanced pumping efficiency.

A shovel plate assembly consists either of a flexible disk sandwiched between two metal support plates or a cup sandwiched between three metal support plates. This assembly is then bolted on the bottom of an existing priming piston shovel rod.

For the disk embodiment, the disk is made from a flexible silicon rubber and has essentially a zero tolerance fit while the cup member is formed from a glass-filled Teflon® polytetrafluoroethylene material and has minimal clearance.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

Figure 1:
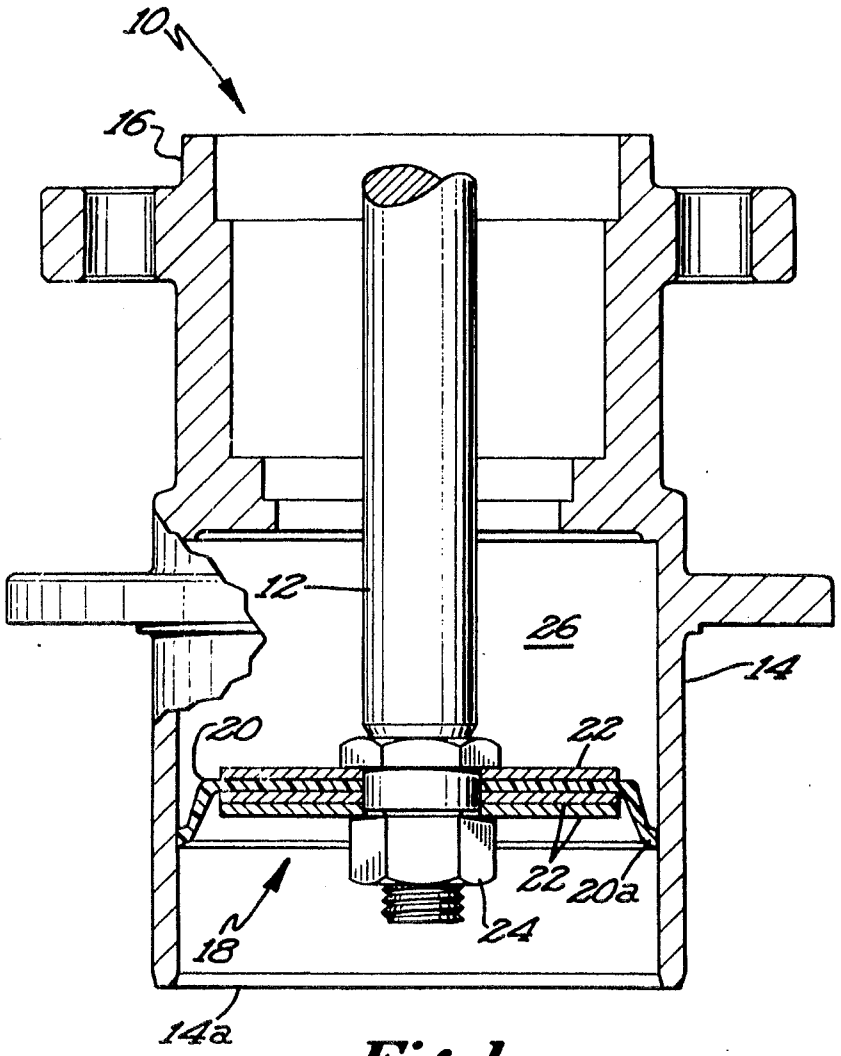
FIG. 1 shows the design of the instant invention utilizing a cup shaped shovel plate assembly.

The instant invention, generally designated 10 in FIG. 1, is comprised of a priming piston shovel rod designated 12 which reciprocates up and down within intake cylinder 14 which is in turn attached to the bottom of pump 16. In one embodiment of the instant invention 10, shovel plate assembly 18 is comprised of a wiper cup 20 formed from a 25% glass-filled Teflon® polytetrafluoroethylene material. The edge 20*a* of cup 20 is provided with a clearance relative to the inside of intake cylinder 14 which is on the order of 0.007 inches. Cup 20 is sandwiched between 3 metal support plates 22 and then secured in place by nut 24 on the end of shovel rod 12.

In operation, as assembly 18 moves downwardly through the position shown in FIG. 1, a vacuum is created in the chamber 26 located above assembly 18 until cup 20 moves downwardly beyond the outside edge 14a of intake cylinder 14 whereupon the pressure in the area outside intake cylinder 14 forces material into the vacuum and enhances loading of the pump.

Figure 2:
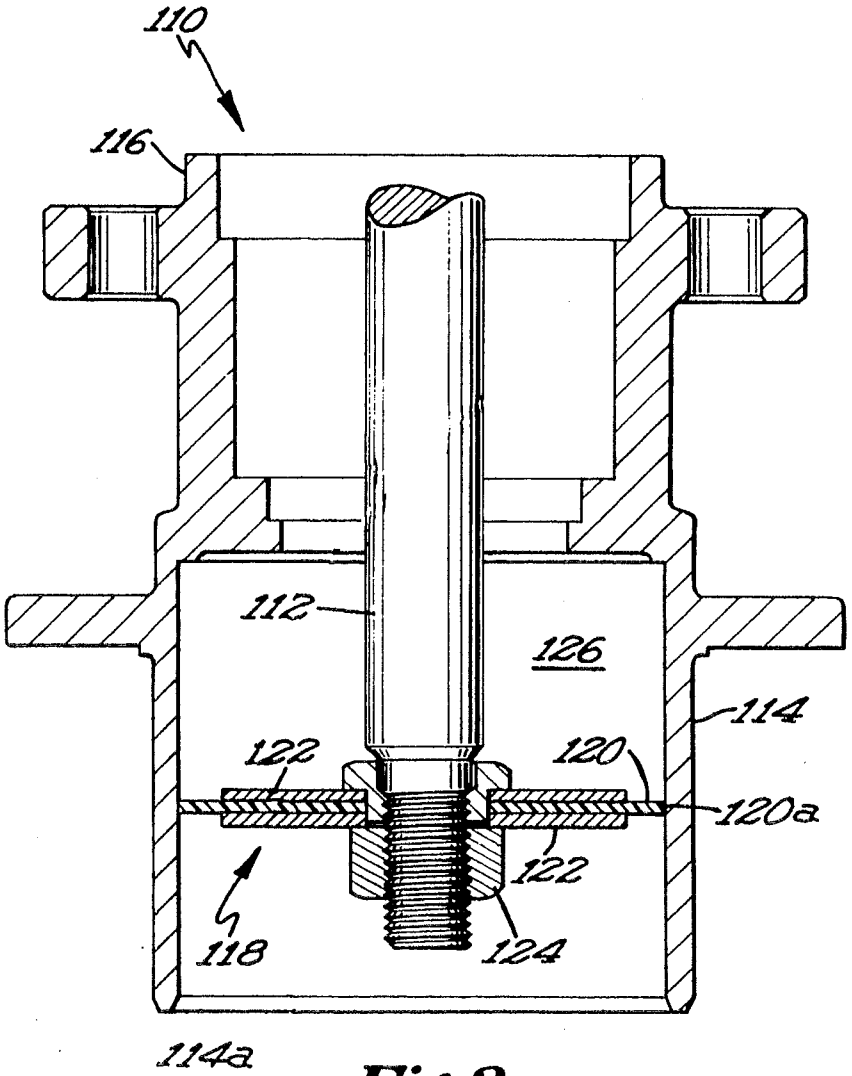
FIG. 2 shows the shovel plate assembly of the instant invention utilizing a disk member.

Turning to the embodiment of FIG. 2, invention 110 is similarly comprised of an intake cylinder 114 having shovel rod 112 therein and is attached to the bottom of pump 116. Shovel plate assembly 118 is comprised of a flexible rubber disk 120 sandwiched by plates 22 and secured in position by nut 124. Disk 120 is desirably formed of a 70 durometer hardness reinforced silicon rubber and sold by Nott Company as their material part number 3320.

The tolerance between the edge 120*a* of the disk and the inside of intake cylinder 114 is essentially zero and this device operates in a similar manner to form a vacuum in loading chamber 126 as assembly 118 moves downwardly.

It is contemplated that various changes and modifications may be made to the reciprocating piston shovel pump without departing from the spirit and scope of the invention as defined by the following claims.

What is claimed is:

1. In a reciprocating piston shovel pump for pumping viscous materials and having a shovel plate assembly at the bottom of a priming piston shovel rod which alternately enters and exits an intake cylinder having an inner diameter, said intake cylinder leading to a piston pump, the improvement in said shovel plate assembly comprising a generally circular flexible member attached to said shovel rod, said flexible member having an outer diameter approximately the same as said intake cylinder inner diameter so as to allow buildup of a vacuum as said shovel plate assembly exits said intake cylinder to enhance loading of the intake cylinder.

2. The shovel pump of claim 1 wherein said shovel plate assembly further comprising at least two rigid support plates sandwiching said flexible member, said support plates having a diameter less than said intake cylinder inner diameter.

3. The shovel pump of claim 2 wherein said flexible member is comprised of silicon rubber.

4. The shovel pump of claim 2 wherein said flexible member is cup shaped.

5. The shovel pump of claim 4 wherein said cup shaped flexible member is comprised of polytetrafluoroethylene.

6. The shovel pump of claim 4 wherein said cup shaped member comprises an opening which faces away from said shovel rod.

* * * * *